US009312634B2

(12) United States Patent
Fullerton et al.

(10) Patent No.: US 9,312,634 B2
(45) Date of Patent: Apr. 12, 2016

(54) ELECTRICAL ADAPTER SYSTEM

(71) Applicant: Correlated Magnetics Research, LLC., Huntsville, AL (US)

(72) Inventors: Larry W. Fullerton, New Hope, AL (US); Mark D. Roberts, Huntsville, AL (US)

(73) Assignee: Correlated Magnetics Research LLC, Huntsville, AL (US)

( * ) Notice: Subject to any disclaimer, the term of this patent is extended or adjusted under 35 U.S.C. 154(b) by 14 days.

(21) Appl. No.: 14/258,787

(22) Filed: Apr. 22, 2014

(65) Prior Publication Data

US 2014/0227896 A1 Aug. 14, 2014

Related U.S. Application Data

(63) Continuation of application No. 13/430,219, filed on Mar. 26, 2012, now Pat. No. 8,702,437.

(60) Provisional application No. 61/465,801, filed on Mar. 24, 2011.

(51) Int. Cl.
*H01R 13/622* (2006.01)
*H01R 13/62* (2006.01)
(Continued)

(52) U.S. Cl.
CPC ..... *H01R 13/622* (2013.01); *H01R 13/6205* (2013.01); *H01R 13/6675* (2013.01); *H01R 31/065* (2013.01); *H01R 33/22* (2013.01)

(58) Field of Classification Search
USPC ..... 439/236, 39, 642, 1, 373, 375, 214; 315/291; 362/648, 249.02
See application file for complete search history.

(56) References Cited

U.S. PATENT DOCUMENTS 93,931 A 8/1869 Westcott
361,248 A 4/1887 Winton
(Continued)

FOREIGN PATENT DOCUMENTS

CN 1615573 A 5/2005
DE 2938782 A1 4/1981
(Continued)

OTHER PUBLICATIONS

C. Pompermaier, L. Sjoberg, and G. Nord, Design and Optimization of a Permanent Magnet Transverse Flux Machine, XXth International Conference on Electrical Machines, Sep. 2012, p. 606, IEEE Catalog No. CFP1290B-PRT, ISBN: 978-1-4673-0143-5.
(Continued)

*Primary Examiner* — Alexander Gilman
(74) *Attorney, Agent, or Firm* — Vector IP Law Group; Robert S. Babayi

(57) ABSTRACT

An electrical system includes an electrical adapter and a stackable electrical adapter. The electrical adapter includes at least one of an electrical plug or an Edison screw base configured to receive a primary voltage, a voltage converter circuit configured to convert the primary voltage to the secondary voltage, and a first electrical connector part configured to be detachably coupled to a second electrical connector part of an electrical fixture configured to be powered by the secondary voltage. The stackable electrical adapter is configured to be powered by the secondary voltage, the first stackable electrical adapter having a first side and a second side opposite the first side. The electrical adapter is configured to be electrically connected to the first side of the first stackable electrical adapter or to an electrical fixture using a two part electrical connector to provide the secondary voltage, a ground, and a data signal, the electrical fixture is configured to be powered by the secondary voltage, where the second side of the stackable electrical adapter is configured to be electrically connected to the electrical fixture or to be daisy-chained to a second stackable electrical adapter using the two part electrical connector to provide the secondary voltage, a ground, and a data signal, the second stackable electrical adapter being configured to be electrically connected to the electrical adapter and the electrical fixture and to be daisy-chained to the first stackable electrical adapter using the two part electrical connector to provide the secondary voltage, a ground, and a data signal.

20 Claims, 8 Drawing Sheets

(Front View)

(51) Int. Cl.

| | |
|---|---|
| ***H01R 13/66*** | (2006.01) |
| ***H01R 31/06*** | (2006.01) |
| ***H01R 33/22*** | (2006.01) |

(56) References Cited

U.S. PATENT DOCUMENTS

| | | | | |
|---|---|---|---|---|
| 493,858 | A | | 3/1893 | Edison |
| 675,323 | A | | 5/1901 | Clark |
| 687,292 | A | | 11/1901 | Armstrong |
| 996,933 | A | | 7/1911 | Lindquist |
| 1,081,462 | A | | 12/1913 | Patton |
| 1,171,351 | A | | 2/1916 | Neuland |
| 1,236,234 | A | | 8/1917 | Troje |
| 1,252,289 | A | | 1/1918 | Murray, Jr. |
| 1,301,135 | A | | 4/1919 | Karasick |
| 1,312,546 | A | | 8/1919 | Karasick |
| 1,323,546 | A | | 8/1919 | Karasick |
| 1,554,236 | A | | 1/1920 | Simmons |
| 1,343,751 | A | | 6/1920 | Simmons |
| 1,624,741 | A | | 12/1926 | Leppke et al. |
| 1,784,256 | A | | 12/1930 | Stout |
| 1,895,129 | A | | 1/1933 | Jones |
| 2,048,161 | A | | 7/1936 | Klaiber |
| 2,147,482 | A | | 12/1936 | Butler |
| 2,186,074 | A | | 1/1940 | Koller |
| 2,240,035 | A | | 4/1941 | Catherall |
| 2,243,555 | A | | 5/1941 | Faus |
| 2,269,149 | A | | 1/1942 | Edgar |
| 2,327,748 | A | | 8/1943 | Smith |
| 2,337,248 | A | | 12/1943 | Koller |
| 2,337,249 | A | | 12/1943 | Koller |
| 2,389,298 | A | | 11/1945 | Ellis |
| 2,401,887 | A | | 6/1946 | Sheppard |
| 2,414,653 | A | | 1/1947 | lokholder |
| 2,438,231 | A | | 3/1948 | Schultz |
| 2,471,634 | A | | 5/1949 | Vennice |
| 2,475,456 | A | | 7/1949 | Norlander |
| 2,508,305 | A | | 5/1950 | Teetor |
| 2,513,226 | A | | 6/1950 | Wylie |
| 2,514,927 | A | | 7/1950 | Bernhard |
| 2,520,828 | A | | 8/1950 | Bertschi |
| 2,565,624 | A | | 8/1951 | phelon |
| 2,570,625 | A | | 10/1951 | Zimmerman et al. |
| 2,690,349 | A | | 9/1954 | Teetor |
| 2,694,164 | A | | 11/1954 | Geppelt |
| 2,964,613 | A | | 11/1954 | Williams |
| 2,701,158 | A | | 2/1955 | Schmitt |
| 2,722,617 | A | | 11/1955 | Cluwen et al. |
| 2,770,759 | A | | 11/1956 | Ahlgren |
| 2,837,366 | A | | 6/1958 | Loeb |
| 2,853,331 | A | | 9/1958 | Teetor |
| 2,888,291 | A | | 5/1959 | Scott et al. |
| 2,896,991 | A | | 7/1959 | Martin, Jr. |
| 2,932,545 | A | | 4/1960 | Foley |
| 2,935,352 | A | | 5/1960 | Heppner |
| 2,935,353 | A | | 5/1960 | Loeb |
| 2,936,437 | A | | 5/1960 | Fraser et al. |
| 2,962,318 | A | | 11/1960 | Teetor |
| 3,055,999 | A | | 9/1962 | Lucas |
| 3,089,986 | A | | 5/1963 | Gauthier |
| 3,102,314 | A | | 9/1963 | Alderfer |
| 3,151,902 | A | | 10/1964 | Ahlgren |
| 3,204,995 | A | | 9/1965 | Teetor |
| 3,208,296 | A | | 9/1965 | Baermann |
| 3,238,399 | A | | 3/1966 | Johanees et al. |
| 3,273,104 | A | | 9/1966 | Krol |
| 3,288,511 | A | | 11/1966 | Tavano |
| 3,301,091 | A | | 1/1967 | Reese |
| 3,351,368 | A | | 11/1967 | Sweet |
| 3,382,386 | A | | 5/1968 | Schlaeppi |
| 3,408,104 | A | | 10/1968 | Raynes |
| 3,414,309 | A | | 12/1968 | Tresemer |
| 3,425,729 | A | | 2/1969 | Bisbing |
| 3,468,576 | A | | 9/1969 | Beyer et al. |
| 3,474,366 | A | | 10/1969 | Barney |
| 3,500,090 | A | | 3/1970 | Baermann |
| 3,521,216 | A | * | 7/1970 | Tolegian ..... 439/39 |
| 3,645,650 | A | | 2/1972 | Laing |
| 3,668,670 | A | | 6/1972 | Andersen |
| 3,684,992 | A | | 8/1972 | Huguet et al. |
| 3,690,393 | A | | 9/1972 | Guy |
| 3,696,258 | A | | 10/1972 | Anderson et al. |
| 3,790,197 | A | | 2/1974 | Parker |
| 3,791,309 | A | | 2/1974 | Baermann |
| 3,802,034 | A | | 4/1974 | Bookless |
| 3,803,433 | A | | 4/1974 | Ingenito |
| 3,808,577 | A | * | 4/1974 | Mathauser ..... 439/39 |
| 3,836,801 | A | | 9/1974 | Yamashita et al. |
| 3,845,430 | A | | 10/1974 | Petkewicz et al. |
| 3,893,059 | A | | 7/1975 | Nowak |
| 3,976,316 | A | | 8/1976 | Laby |
| 4,079,558 | A | | 3/1978 | Gorham |
| 4,117,431 | A | | 9/1978 | Eicher |
| 4,129,846 | A | | 12/1978 | Yablochnikov |
| 4,209,905 | A | | 7/1980 | Gillings |
| 4,222,489 | A | * | 9/1980 | Hutter ..... 211/45 |
| 4,296,394 | A | | 10/1981 | Ragheb |
| 4,340,833 | A | | 7/1982 | Sudo et al. |
| 4,352,960 | A | | 10/1982 | Dormer et al. |
| 4,355,236 | A | | 10/1982 | Holsinger |
| 4,399,595 | A | | 8/1983 | Yoon et al. |
| 4,416,127 | A | * | 11/1983 | Gomez-Olea Naveda ..... 70/276 |
| 4,451,811 | A | | 5/1984 | Hoffman |
| 4,453,294 | A | | 6/1984 | Morita |
| 4,517,483 | A | | 5/1985 | Hucker et al. |
| 4,535,278 | A | | 8/1985 | Asakawa |
| 4,547,756 | A | | 10/1985 | Miller et al. |
| 4,629,131 | A | | 12/1986 | Podell |
| 4,645,283 | A | * | 2/1987 | MacDonald et al. ..... 439/236 |
| 4,680,494 | A | | 7/1987 | Grosjean |
| 381,968 | A | | 5/1988 | Tesla |
| 4,764,743 | A | | 8/1988 | Leupold et al. |
| 4,808,955 | A | | 2/1989 | Godkin et al. |
| 4,837,539 | A | | 6/1989 | Baker |
| 4,849,749 | A | | 7/1989 | Fukamachi et al. |
| 4,862,128 | A | | 8/1989 | Leupold |
| H0693 | H | | 10/1989 | Leupold |
| 4,893,103 | A | | 1/1990 | Leupold |
| 4,912,727 | A | | 3/1990 | Schubert |
| 4,941,236 | A | | 7/1990 | Sherman et al. |
| 4,956,625 | A | | 9/1990 | Cardone et al. |
| 4,980,593 | A | | 12/1990 | Edmundson |
| 4,993,950 | A | | 2/1991 | Mensor, Jr. |
| 4,994,778 | A | | 2/1991 | Leupold |
| 4,996,457 | A | | 2/1991 | Hawsey et al. |
| 5,013,949 | A | | 5/1991 | Mabe, Jr. |
| 5,020,625 | A | | 6/1991 | Yamauchi et al. |
| 5,050,276 | A | * | 9/1991 | Pemberton ..... 24/303 |
| 5,062,855 | A | | 11/1991 | Rincoe |
| 5,123,843 | A | | 6/1992 | Van der Zel et al. |
| 5,179,307 | A | | 1/1993 | Porter |
| 5,190,325 | A | | 3/1993 | Doss-Desouza |
| 5,213,307 | A | | 5/1993 | Perrillat-Amede |
| 5,302,929 | A | | 4/1994 | Kovacs |
| 5,309,680 | A | | 5/1994 | Kiel |
| 5,345,207 | A | | 9/1994 | Gebele |
| 5,349,258 | A | | 9/1994 | Leupold et al. |
| 5,367,891 | A | | 11/1994 | Furuyama |
| 5,383,049 | A | | 1/1995 | Carr |
| 5,394,132 | A | | 2/1995 | Poil |
| 5,399,933 | A | | 3/1995 | Tsai |
| 5,425,763 | A | | 6/1995 | Stemmann |
| 5,440,997 | A | | 8/1995 | Crowley |
| 5,461,386 | A | | 10/1995 | Knebelkamp |
| 5,485,435 | A | | 1/1996 | Matsuda et al. |
| 5,492,572 | A | | 2/1996 | Schroeder et al. |
| 5,495,221 | A | | 2/1996 | Post |
| 5,512,732 | A | | 4/1996 | Yagnik et al. |
| 5,570,084 | A | | 10/1996 | Ritter et al. |
| 5,582,522 | A | * | 12/1996 | Johnson ..... 439/214 |
| 5,604,960 | A | | 2/1997 | Good |
| 5,631,093 | A | | 5/1997 | Perry et al. |
| 5,631,618 | A | | 5/1997 | Trumper et al. |
| 5,633,555 | A | | 5/1997 | Ackermann et al. |

(56) References Cited

U.S. PATENT DOCUMENTS 5,635,889 A 6/1997 Stelter
5,637,972 A 6/1997 Randall et al.
5,730,155 A 3/1998 Allen
5,742,036 A 4/1998 Schramm, Jr. et al.
5,759,054 A * 6/1998 Spadafore ..... 439/236
5,788,493 A 8/1998 Tanaka et al.
5,838,304 A 11/1998 Hall
5,852,393 A 12/1998 Reznik et al.
5,935,155 A 8/1999 Humayun et al.
5,956,778 A 9/1999 Godoy
5,983,406 A 11/1999 Meyerrose
6,000,484 A 12/1999 Zoretich et al.
6,039,759 A 3/2000 Carpentier et al.
6,047,456 A 4/2000 Yao et al.
6,072,251 A 6/2000 Markle
6,074,420 A 6/2000 Eaton
6,104,108 A 8/2000 Hazelton et al.
6,115,849 A 9/2000 Meyerrose
6,118,271 A 9/2000 Ely et al.
6,120,283 A * 9/2000 Cousins ..... 431/289
6,125,955 A 10/2000 Zoretich et al.
6,142,779 A 11/2000 Siegel et al.
6,170,131 B1 1/2001 Shin
6,187,041 B1 2/2001 Garonzik
6,188,147 B1 2/2001 Hazelton et al.
6,205,012 B1 3/2001 Lear
6,210,033 B1 4/2001 Karkos, Jr. et al.
6,224,374 B1 5/2001 Mayo
6,234,833 B1 * 5/2001 Tsai et al. ..... 439/541.5
6,241,069 B1 6/2001 Mazur et al.
6,273,918 B1 8/2001 Yuhasz et al.
6,275,778 B1 8/2001 Shimada et al.
6,285,097 B1 9/2001 Hazelton et al.
6,387,096 B1 5/2002 Hyde, Jr.
6,422,533 B1 7/2002 Harms
6,433,493 B1 * 8/2002 Ilyes et al. ..... 315/291
6,457,179 B1 10/2002 Prendergast
6,467,326 B1 10/2002 Garrigus
6,535,092 B1 3/2003 Hurley et al.
6,540,515 B1 4/2003 Tanaka
6,561,815 B1 5/2003 Schmidt
6,599,321 B2 7/2003 Hyde, Jr.
6,607,304 B1 8/2003 Lake et al.
6,652,278 B2 11/2003 Honkura et al.
6,653,919 B2 11/2003 Shih-Chung et al.
6,720,698 B2 * 4/2004 Galbraith ..... 310/166
6,747,537 B1 6/2004 Mosteller
6,821,126 B2 11/2004 Neidlein
6,841,910 B2 1/2005 Gery
6,842,332 B1 1/2005 Rubenson et al.
6,847,134 B2 1/2005 Frissen et al.
6,850,139 B1 2/2005 Dettmann et al.
6,862,748 B2 3/2005 Prendergast
6,864,773 B2 3/2005 Perrin
6,913,471 B2 * 7/2005 Smith ..... 439/74
6,927,657 B1 8/2005 Wu
6,936,937 B2 8/2005 Tu et al.
6,954,968 B1 10/2005 Sitbon
6,971,147 B2 12/2005 Halstead
7,009,874 B2 3/2006 Deak
7,016,492 B2 3/2006 Pan et al.
7,031,160 B2 4/2006 Tillotson
7,033,400 B2 4/2006 Currier
7,038,565 B1 5/2006 Chell
7,065,860 B2 6/2006 Aoki et al.
7,066,739 B2 * 6/2006 McLeish ..... 439/39
7,066,778 B2 6/2006 Kretzschmar
7,097,461 B2 8/2006 Neidlein
7,101,374 B2 9/2006 Hyde, Jr.
7,135,792 B2 11/2006 Devaney et al.
7,137,727 B2 * 11/2006 Joseph et al. ..... 362/648
7,148,440 B2 * 12/2006 Gjerde ..... 200/569
7,186,265 B2 3/2007 Sharkawy et al.
7,224,252 B2 5/2007 Meadow, Jr. et al.
7,264,479 B1 * 9/2007 Lee ..... 439/39
7,276,025 B2 * 10/2007 Roberts et al. ..... 600/249
7,311,526 B2 12/2007 Rohrbach et al.
7,339,790 B2 * 3/2008 Baker et al. ..... 361/709
7,344,380 B2 3/2008 Neidlein et al.
7,351,066 B2 4/2008 DiFonzo et al.
7,358,724 B2 4/2008 Taylor et al.
7,362,018 B1 4/2008 Kulogo et al.
7,364,433 B2 4/2008 Neidlein
7,381,181 B2 6/2008 Lau et al.
7,402,175 B2 7/2008 Azar
7,416,414 B2 8/2008 Bozzone et al.
7,438,726 B2 10/2008 Erb
7,444,683 B2 11/2008 Prendergast et al.
7,453,341 B1 11/2008 Hildenbrand
7,467,948 B2 * 12/2008 Lindberg et al. ..... 439/38
7,498,914 B2 3/2009 Miyashita et al.
7,583,500 B2 9/2009 Ligtenberg et al.
7,637,746 B2 12/2009 Lindberg et al.
7,645,143 B2 1/2010 Rohrbach et al.
7,658,613 B1 2/2010 Griffin et al.
7,715,890 B2 5/2010 Kim et al.
7,762,817 B2 7/2010 Ligtenberg et al.
7,775,567 B2 8/2010 Ligtenberg et al.
7,796,002 B2 9/2010 Hashimoto et al.
7,799,281 B2 9/2010 Cook et al.
7,808,349 B2 10/2010 Fullerton et al.
7,812,697 B2 * 10/2010 Fullerton et al. ..... 335/306
7,817,004 B2 10/2010 Fullerton et al.
7,828,556 B2 11/2010 Rodrigues
7,832,897 B2 * 11/2010 Ku ..... 362/249.02
7,837,032 B2 11/2010 Smeltzer
7,839,246 B2 11/2010 Fullerton et al.
7,843,297 B2 11/2010 Fullerton et al.
7,868,721 B2 1/2011 Fullerton et al.
7,871,272 B2 1/2011 Firman, II et al.
7,874,856 B1 * 1/2011 Schriefer et al. ..... 439/214
7,889,037 B2 2/2011 Cho
7,901,216 B2 3/2011 Rohrbach et al.
7,903,397 B2 * 3/2011 McCoy ..... 361/679.01
7,905,626 B2 * 3/2011 Shantha et al. ..... 362/228
7,997,906 B2 8/2011 Ligenberg et al.
8,002,585 B2 * 8/2011 Zhou ..... 439/642
8,009,001 B1 8/2011 Cleveland
8,050,714 B2 11/2011 Fadell et al.
8,078,224 B2 12/2011 Fadell et al.
8,078,776 B2 12/2011 Novotney et al.
8,087,939 B2 1/2012 Rohrbach et al.
8,099,964 B2 1/2012 Saito et al.
8,138,869 B1 3/2012 Lauder et al.
8,143,982 B1 3/2012 Lauder et al.
8,143,983 B1 3/2012 Lauder et al.
8,165,634 B2 4/2012 Fadell et al.
8,177,560 B2 5/2012 Rohrbach et al.
8,187,006 B2 5/2012 Rudisill et al.
8,190,205 B2 5/2012 Fadell et al.
8,242,868 B2 8/2012 Lauder et al.
8,253,518 B2 8/2012 Lauder et al.
8,264,310 B2 9/2012 Lauder et al.
8,264,314 B2 9/2012 Sankar
8,271,038 B2 9/2012 Fadell et al.
8,271,705 B2 9/2012 Novotney et al.
8,297,367 B2 10/2012 Chen et al.
8,344,836 B2 1/2013 Lauder et al.
8,348,678 B2 1/2013 Hardisty et al.
8,354,767 B2 1/2013 Pennander et al.
8,390,411 B2 3/2013 Lauder et al.
8,390,412 B2 3/2013 Lauder et al.
8,390,413 B2 3/2013 Lauder et al.
8,395,465 B2 3/2013 Lauder et al.
8,398,409 B2 3/2013 Schmidt
8,435,042 B2 5/2013 Rohrbach et al.
8,454,372 B2 6/2013 Lee et al.
8,467,829 B2 6/2013 Fadell et al.
8,497,753 B2 * 7/2013 DiFonzo et al. ..... 335/205
8,514,042 B2 8/2013 Lauder et al.
8,535,088 B2 9/2013 Gao et al.
8,576,031 B2 11/2013 Lauder et al.
8,576,034 B2 11/2013 Bilbrey et al.
8,616,362 B1 12/2013 Browne et al.

(56) References Cited

U.S. PATENT DOCUMENTS

| | | | | |
|---|---|---|---|---|
| 8,648,679 | B2 | 2/2014 | Lauder et al. | |
| 8,665,044 | B2 | 3/2014 | Lauder et al. | |
| 8,665,045 | B2 | 3/2014 | Lauder et al. | |
| 8,690,582 | B2 | 4/2014 | Rohrbach et al. | |
| 8,702,316 | B2 | 4/2014 | DiFonzo et al. | |
| 8,734,024 | B2 | 5/2014 | Isenhour et al. | |
| 8,734,165 | B2 * | 5/2014 | Neel | 439/39 |
| 8,752,200 | B2 | 6/2014 | Varshavsky et al. | |
| 8,757,893 | B1 | 6/2014 | Isenhour et al. | |
| 8,770,857 | B2 | 7/2014 | DiFonzo et al. | |
| 8,774,577 | B2 | 7/2014 | Benjamin et al. | |
| 8,781,273 | B2 | 7/2014 | Benjamin et al. | |
| 8,836,224 | B2 * | 9/2014 | Chen et al. | 315/185 R |
| 2002/0125977 | A1 | 9/2002 | VanZoest | |
| 2003/0136837 | A1 | 7/2003 | Amon et al. | |
| 2003/0170976 | A1 | 9/2003 | Molla et al. | |
| 2003/0179880 | A1 | 9/2003 | Pan et al. | |
| 2003/0187510 | A1 | 10/2003 | Hyde | |
| 2004/0003487 | A1 * | 1/2004 | Reiter | 24/303 |
| 2004/0155748 | A1 | 8/2004 | Steingroever | |
| 2004/0244636 | A1 | 12/2004 | Meadow et al. | |
| 2004/0251759 | A1 | 12/2004 | Hirzel | |
| 2005/0102802 | A1 | 5/2005 | Sitbon et al. | |
| 2005/0196484 | A1 | 9/2005 | Khoshnevis | |
| 2005/0231046 | A1 | 10/2005 | Aoshima | |
| 2005/0240263 | A1 | 10/2005 | Fogarty et al. | |
| 2005/0263549 | A1 | 12/2005 | Scheiner | |
| 2005/0283839 | A1 | 12/2005 | Cowburn | |
| 2006/0066428 | A1 | 3/2006 | McCarthy et al. | |
| 2006/0105586 | A1 * | 5/2006 | Zhang et al. | 439/1 |
| 2006/0189259 | A1 | 8/2006 | Park et al. | |
| 2006/0198047 | A1 | 9/2006 | Xue et al. | |
| 2006/0198998 | A1 | 9/2006 | Raksha et al. | |
| 2006/0214756 | A1 | 9/2006 | Elliott et al. | |
| 2006/0290451 | A1 | 12/2006 | Prendergast et al. | |
| 2006/0293762 | A1 | 12/2006 | Schulman et al. | |
| 2007/0072476 | A1 * | 3/2007 | Milan | 439/373 |
| 2007/0075594 | A1 | 4/2007 | Sadler | |
| 2007/0103266 | A1 | 5/2007 | Wang et al. | |
| 2007/0138806 | A1 | 6/2007 | Ligtenberg et al. | |
| 2007/0255400 | A1 | 11/2007 | Parravicini et al. | |
| 2007/0267929 | A1 | 11/2007 | Pulnikov et al. | |
| 2008/0119250 | A1 | 5/2008 | Cho et al. | |
| 2008/0139261 | A1 | 6/2008 | Cho et al. | |
| 2008/0174392 | A1 | 7/2008 | Cho | |
| 2008/0181804 | A1 | 7/2008 | Tanigawa et al. | |
| 2008/0186683 | A1 | 8/2008 | Ligtenberg et al. | |
| 2008/0218299 | A1 | 9/2008 | Arnold | |
| 2008/0224806 | A1 | 9/2008 | Ogden et al. | |
| 2008/0272868 | A1 | 11/2008 | Prendergast et al. | |
| 2008/0282517 | A1 | 11/2008 | Claro | |
| 2009/0011652 | A1 | 1/2009 | Koh | |
| 2009/0021333 | A1 | 1/2009 | Fiedler | |
| 2009/0209173 | A1 | 8/2009 | Arledge et al. | |
| 2009/0250576 | A1 | 10/2009 | Fullerton et al. | |
| 2009/0251256 | A1 | 10/2009 | Fullerton et al. | |
| 2009/0254196 | A1 | 10/2009 | Cox et al. | |
| 2009/0278642 | A1 | 11/2009 | Fullerton et al. | |
| 2009/0289090 | A1 | 11/2009 | Fullerton et al. | |
| 2009/0289749 | A1 | 11/2009 | Fullerton et al. | |
| 2009/0292371 | A1 | 11/2009 | Fullerton et al. | |
| 2010/0033280 | A1 | 2/2010 | Bird et al. | |
| 2010/0126857 | A1 | 5/2010 | Polwart et al. | |
| 2010/0167576 | A1 * | 7/2010 | Zhou | 439/375 |
| 2011/0026203 | A1 | 2/2011 | Ligtenberg et al. | |
| 2011/0085157 | A1 | 4/2011 | Bloss et al. | |
| 2011/0101088 | A1 | 5/2011 | Marguerettaz et al. | |
| 2011/0210636 | A1 | 9/2011 | Kuhlmann-Wilsdorf | |
| 2011/0234344 | A1 | 9/2011 | Fullerton et al. | |
| 2011/0248806 | A1 | 10/2011 | Michael | |
| 2011/0279206 | A1 | 11/2011 | Fullerton et al. | |
| 2012/0007704 | A1 | 1/2012 | Nerl | |
| 2012/0021619 | A1 * | 1/2012 | Bilbrey et al. | 439/39 |
| 2012/0028480 | A1 * | 2/2012 | Bilbrey et al. | 439/39 |
| 2012/0064309 | A1 | 3/2012 | Kwon et al. | |
| 2012/0085753 | A1 | 4/2012 | Fitch et al. | |
| 2012/0146513 | A1 * | 6/2012 | Radermacher | 315/119 |
| 2012/0235519 | A1 | 9/2012 | Dyer et al. | |
| 2012/0244732 | A1 * | 9/2012 | Fullerton et al. | 439/236 |
| 2013/0001745 | A1 | 1/2013 | Iwaki | |
| 2013/0186209 | A1 | 7/2013 | Herbst | |
| 2013/0186473 | A1 | 7/2013 | Mankame et al. | |
| 2013/0186807 | A1 | 7/2013 | Browne et al. | |
| 2013/0187538 | A1 | 7/2013 | Herbst | |
| 2013/0192860 | A1 | 8/2013 | Puzio et al. | |
| 2013/0207758 | A1 | 8/2013 | Browne et al. | |
| 2013/0252375 | A1 | 9/2013 | Yi et al. | |
| 2013/0256274 | A1 | 10/2013 | Faulkner | |
| 2013/0279060 | A1 | 10/2013 | Nehl | |
| 2013/0305705 | A1 | 11/2013 | Ac et al. | |
| 2013/0341137 | A1 | 12/2013 | Mandame et al. | |
| 2014/0044972 | A1 | 2/2014 | Menassa et al. | |
| 2014/0072261 | A1 | 3/2014 | Isenhour et al. | |
| 2014/0152252 | A1 | 6/2014 | Wood et al. | |
| 2014/0205235 | A1 | 7/2014 | Benjamin et al. | |
| 2014/0221741 | A1 | 8/2014 | Wang et al. | |
| 2014/0235075 | A1 | 8/2014 | Kim et al. | |
| 2014/0350701 | A1 * | 11/2014 | Underwood | 700/83 |

FOREIGN PATENT DOCUMENTS

| | | | |
|---|---|---|---|
| EP | 0 345 554 | A1 | 12/1989 |
| EP | 0 545 737 | A1 | 6/1993 |
| FR | 823395 | A | 1/1938 |
| GB | 1 495 677 | A | 12/1977 |
| JP | S57-55908 | U | 4/1982 |
| JP | S57-189423 | U | 12/1982 |
| JP | 60-091011 | U | 6/1985 |
| JP | 60-221238 | A | 11/1985 |
| JP | 64-30444 | A | 2/1989 |
| JP | 2001-328483 | A | 11/2001 |
| JP | 2006210269 | A1 | 8/2006 |
| JP | 2008035676 | A | 2/2008 |
| JP | 2008165974 | A | 7/2008 |
| JP | 05-038123 | B2 | 10/2012 |
| KR | 101265730 | B1 | 5/2013 |
| WO | WO-02/31945 | A2 | 4/2002 |
| WO | WO-2007/081830 | A2 | 7/2007 |
| WO | WO-2009/124030 | A1 | 10/2009 |
| WO | WO-2010/141324 | A1 | 12/2010 |
| WO | 2013088143 | A1 | 6/2013 |

OTHER PUBLICATIONS

V. Rudnev, An Objective Assessment of Magnetic Flux Concentrators, HET Trating Progress, Nov./Dec. 2004, p. 19-23.

International Search Report and Written Opinion for International PCT Application No. PCT/US2014/058294, mailed Jan. 5, 2015, 9 pages.

Atallah, K., Calverley, S.D., D. Howe, 2004, "Design, analysis and realisation of a high-performance magnetic gear", IEE Proc.-Electr. Power Appl., vol. 151, No. 2, Mar. 2004.

Atallah, K., Howe, D. 2001, "A Novel High-Performance Magnetic Gear", IEEE Transactions on Magnetics, vol. 37, No. 4, Jul. 2001, p. 2844-46.

Bassani, R., 2007, "Dynamic Stability of Passive Magnetic Bearings", Nonlinear Dynamics, V. 50, p. 161-68.

BNS 33 Range, Magnetic safety sensors, Rectangular design, http://www.farnell.com/datasheets/36449.pdf, 3 pages, date unknown.

Boston Gear 221S-4, One-stage Helical Gearbox, http://www.bostongear.com/pdf/product_sections/200_series_helical.pdf, referenced Jun. 2010.

Charpentier et al., 2001, "Mechanical Behavior of Axially Magnetized Permanent-Magnet Gears", IEEE Transactions on Magnetics, vol. 37, No. 3, May 2001, p. 1110-17.

Chau et al., 2008, "Transient Analysis of Coaxial Magnetic Gears Using Finite Element Comodeling", Journal of Applied Physics, vol. 103.

Choi et al., 2010, "Optimization of Magnetization Directions in a 3-D Magnetic Structure", IEEE Transactions on Magnetics, vol. 46, No. 6, Jun. 2010, p. 1603-06.

(56) References Cited

OTHER PUBLICATIONS

Correlated Magnetics Research, 2009, Online Video, "Innovative Magnetics Research in Huntsville", http://www.youtube.com/watch?v=m4m81JjZCJo.
Correlated Magnetics Research, 2009, Online Video, "Non-Contact Attachment Utilizing Permanent Magnets", http://www.youtube.com/watch?v=3xUm25CNNgQ.
Correlated Magnetics Research, 2010, Company Website, http://www.correlatedmagnetics.com.
Furlani 1996, "Analysis and optimization of synchronous magnetic couplings", J. Appl. Phys., vol. 79, No. 8, p. 4692.
Furlani 2001, "Permanent Magnet and Electromechanical Devices", Academic Press, San Diego.
Furlani, E.P., 2000, "Analytical analysis of magnetically coupled multipole cylinders", J. Phys. D: Appl. Phys., vol. 33, No. 1, p. 28-33.
General Electric DP 2.7 Wind Turbine Gearbox, http://www.gedrivetrain.com/insideDP27.cfm, referenced Jun. 2010.
Ha et al., 2002, "Design and Characteristic Analysis of Non-Contact Magnet Gear for Conveyor by Using Permanent Magnet", Conf. Record of the 2002 IEEE Industry Applications Conference, p. 1922-27.
Huang et al., 2008, "Development of a Magnetic Planetary Gearbox", IEEE Transactions on Magnetics, vol. 44, No. 3, p. 403-12.
International Search Report and Written Opinion dated Jun. 1, 2009, directed to counterpart application No. PCT/US2009/002027. (10 pages).
International Search Report and Written Opinion of the International Searching Authority issued in Application No. PCT/US12/61938 dated Feb. 26, 2013.
International Search Report and Written Opinion of the International Searching Authority issued in Application No. PCT/US2013/028095 dated May 13, 2013.
International Search Report and Written Opinion of the International Searching Authority issued in Application No. PCT/US2013/047986 dated Nov. 21, 2013.
International Search Report and Written Opinion, dated Apr. 8, 2011 issued in related International Application No. PCT/US2010/049410.
International Search Report and Written Opinion, dated Aug. 18, 2010, issued in related International Application No. PCT/US2010/036443.
International Search Report and Written Opinion, dated Jul. 13, 2010, issued in related International Application No. PCT/US2010/021612.
International Search Report and Written Opinion, dated May 14, 2009, issued in related International Application No. PCT/US2009/038925.
Jian et al., "Comparison of Coaxial Magnetic Gears With Different Topologies", IEEE Transactions on Magnetics, vol. 45, No. 10, Oct. 2009, p. 4526-29.
Jian, L., Chau, K.T., 2010, "A Coaxial Magnetic Gear With Halbach Permanent-Magnet Arrays", IEEE Transactions on Energy Conversion, vol. 25, No. 2, Jun. 2010, p. 319-28.
Jørgensen et al., "The Cycloid Permanent Magnetic Gear", IEEE Transactions on Industry Applications, vol. 44, No. 6, Nov./Dec. 2008, p. 1659-65.
Jørgensen et al., 2005, "Two dimensional model of a permanent magnet spur gear", Conf. Record of the 2005 IEEE Industry Applications Conference, p. 261-5.
Kim, "A future cost trends of magnetizer systems in Korea", Industrial Electronics, Control, and Instrumentation, 1996, vol. 2, Aug. 5, 1996, pp. 991-996.
Krasil'nikov et al., 2008, "Calculation of the Shear Force of Highly Coercive Permanent Magnets in Magnetic Systems With Consideration of Affiliation to a Certain Group Based on Residual Induction", Chemical and Petroleum Engineering, vol. 44, Nos. 7-8, p. 362-65.
Krasil'nikov et al., 2009, "Torque Determination for a Cylindrical Magnetic Clutch", Russian Engineering Research, vol. 29, No. 6, pp. 544-547.
Liu et al., 2009, "Design and Analysis of Interior-magnet Outer-rotor Concentric Magnetic Gears", Journal of Applied Physics, vol. 105.
Lorimer, W., Hartman, A., 1997, "Magnetization Pattern for Increased Coupling in Magnetic Clutches", IEEE Transactions on Magnetics, vol. 33, No. 5, Sep. 1997.
Mezani, S., Atallah, K., Howe, D. , 2006, "A high-performance axial-field magnetic gear", Journal of Applied Physics vol. 99.
Mi, "Magnetreater/Charger Model 580" Magnetic Instruments Inc. Product specification, May 4, 2009, http://web.archive.org/web/20090504064511/http://www.maginst.com/specifications/580_magnetreater.htm, 2 pages.
Neugart PLE-160, One-Stage Planetary Gearbox, http://www.neugartusa.com/ple_160_gb.pdf, referenced Jun. 2010.
Series BNS, Compatible Series AES Safety Controllers, http://www.schmersalusa.com/safety_controllers/drawings/aes.pdf, pp. 159-175, date unknown.
Series BNS-B20, Coded-Magnet Sensorr Safety Door Handle, http://www.schmersalusa.com/catalog_pdfs/BNS_B20.pdf, 2pages, date unknown.
Series BNS333, Coded-Magnet Sensors with Integral Safety Control Module, http://www.schmersalusa.com/machine_guarding/coded_magnet/drawings/bns333.pdf, 2 pages, date unknown.
Tsurumoto 1992, "Basic Analysis on Transmitted Force of Magnetic Gear Using Permanent Magnet", IEEE Translation Journal on Magnetics in Japan, Vo 7, No. 6, Jun. 1992, p. 447-52.
United States Office Action issued in U.S. Appl. No. 13/104,393 dated Apr. 4, 2013.
United States Office Action issued in U.S. Appl. No. 13/236,413 dated Jun. 6, 2013.
United States Office Action issued in U.S. Appl. No. 13/246,584 dated May 16, 2013.
United States Office Action issued in U.S. Appl. No. 13/246,584 dated Oct. 15, 2013.
United States Office Action issued in U.S. Appl. No. 13/374,074 dated Feb. 21, 2013.
United States Office Action issued in U.S. Appl. No. 13/430,219 dated Aug. 13, 2013.
United States Office Action issued in U.S. Appl. No. 13/470,994 dated Aug. 8, 2013.
United States Office Action issued in U.S. Appl. No. 13/470,994 dated Jan. 7, 2013.
United States Office Action issued in U.S. Appl. No. 13/470,994 dated Nov. 8, 2013.
United States Office Action issued in U.S. Appl. No. 13/529,520 dated Sep. 28, 2012.
United States Office Action issued in U.S. Appl. No. 13/530,893 dated Mar. 22, 2013.
United States Office Action issued in U.S. Appl. No. 13/530,893 dated Oct. 29, 2013.
United States Office Action issued in U.S. Appl. No. 13/718,839 dated Dec. 16, 2013.
United States Office Action issued in U.S. Appl. No. 13/855,519 dated Jul. 17, 2013.
United States Office Action issued in U.S. Appl. No. 13/928,126 dated Oct. 11, 2013.
United States Office Action, dated Aug. 26, 2011, issued in counterpart U.S. Appl. No. 12/206,270.
United States Office Action, dated Feb. 2, 2011, issued in counterpart U.S. Appl. No. 12/476,952.
United States Office Action, dated Mar. 12, 2012, issued in counterpart U.S. Appl. No. 12/206,270.
United States Office Action, dated Mar. 9, 2012, issued in counterpart U.S. Appl. No. 13/371,280.
United States Office Action, dated Oct. 12, 2011, issued in counterpart U.S. Appl. No. 12/476,952.
Wikipedia, "Barker Code", Web article, last modified Aug. 2, 2008, 2 pages.
Wikipedia, "Bitter Electromagnet", Web article, last modified Aug. 2011, 1 page.
Wikipedia, "Costas Array", Web article, last modified Oct. 7, 2008, 4 pages.
Wikipedia, "Gold Code", Web article, last modified Jul. 27, 2008, 1 page.

(56) References Cited

OTHER PUBLICATIONS

Wikipedia, "Golomb Ruler", Web article, last modified Nov. 4, 2008, 3 pages.
Wikipedia, "Kasami Code", Web article, last modified Jun. 11, 2008, 1 page.
Wikipedia, "Linear feedback shift register", Web article, last modified Nov. 11, 2008, 6 pages.
Wikipedia, "Walsh Code", Web article, last modified Sep. 17, 2008, 2 pages.

* cited by examiner

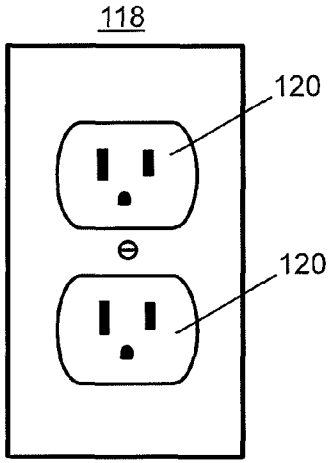
FIG. 1C (Prior Art)
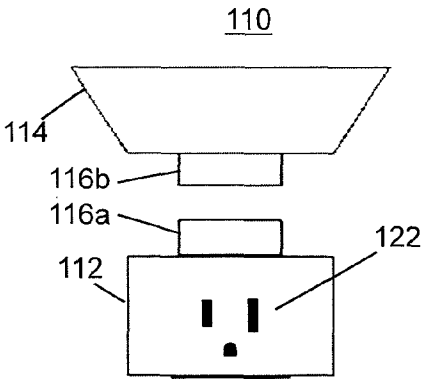
FIG. 1D (Front View)
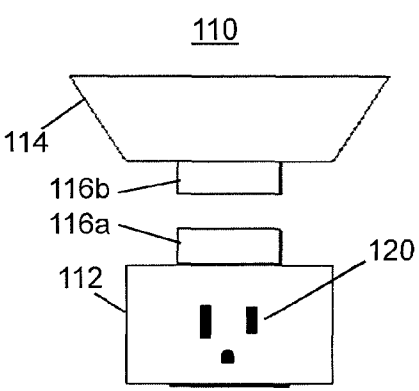
FIG. 1E (Back View)
FIG. 1F (Front View)
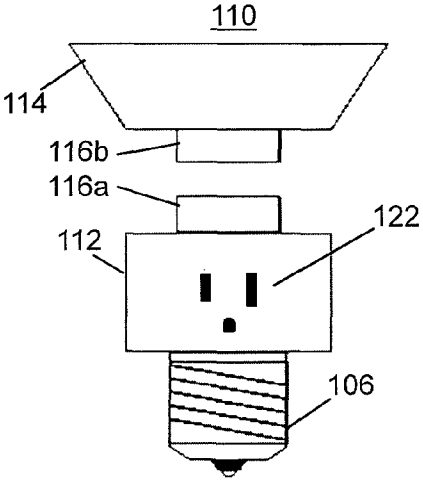
FIG. 1G (Front View)
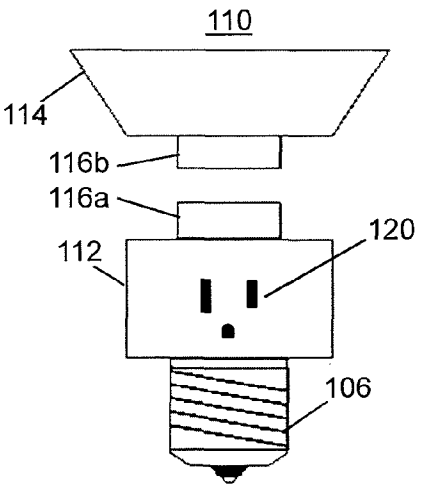
FIG. 1H (Back View)

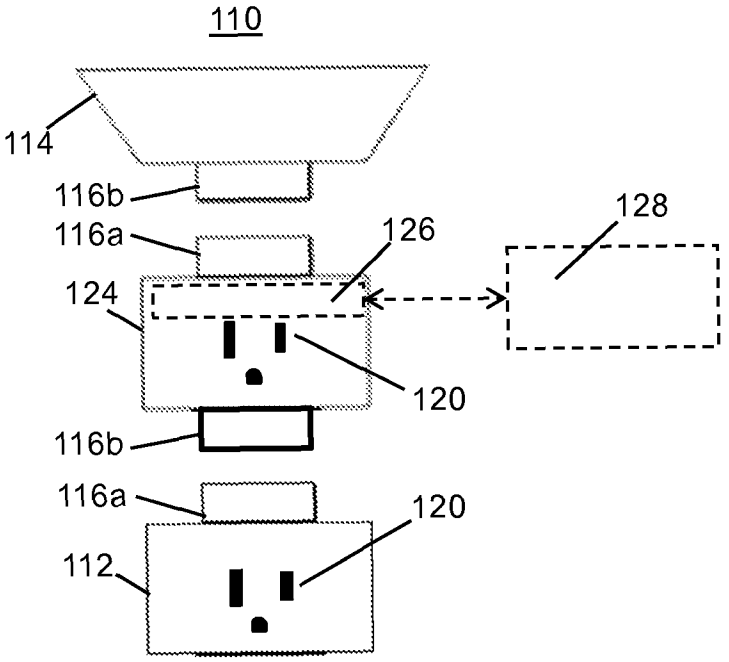
FIG. 1J (Back View)
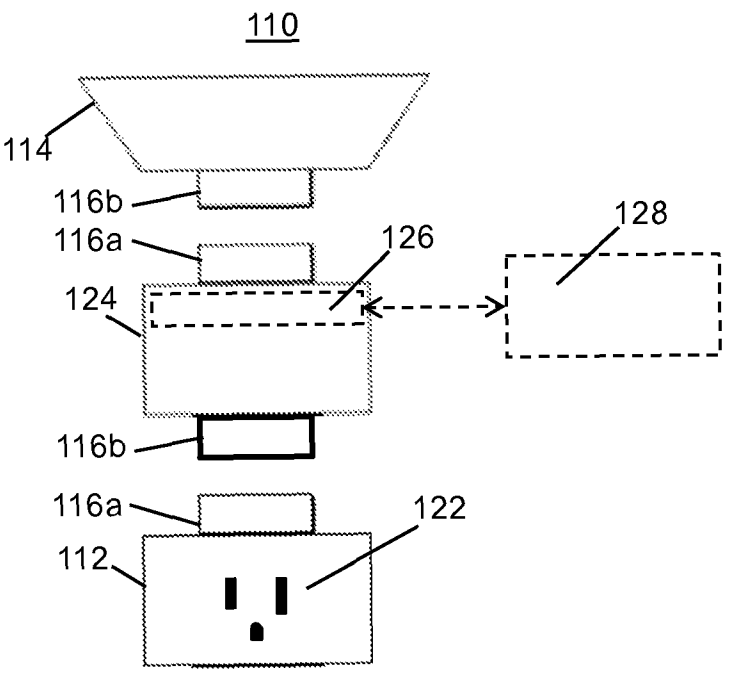
FIG. 1I (Front View)

ELECTRICAL ADAPTER SYSTEM

CROSS-REFERENCE TO RELATED APPLICATIONS

This patent application is a continuation of U.S. Nonprovisional application Ser. No. 13/430,219, filed Mar. 26, 2012, titled "Electrical Adapter System", which claims the priority benefit of U.S. Provisional Application No. 61/465,801, filed Mar. 24, 2011, titled "Electrical Adapter System". These applications are incorporated herein by reference in their entirety.

FIELD OF THE INVENTION

The present invention relates generally to an electrical adapter system. More particularly, the present invention relates to an electrical adapter system including an electrical adapter for connecting to an electrical fixture.

BRIEF DESCRIPTION OF THE DRAWINGS

The present invention is described with reference to the accompanying drawings. In the drawings, like reference numbers indicate identical or functionally similar elements. Additionally, the left-most digit(s) of a reference number identifies the drawing in which the reference number first appears.

FIG. 1C depicts an exemplary electrical outlet;

FIG. 1D depicts a front view of an exemplary multi-part electrical system in accordance with the present invention;

FIG. 1E depicts a back view of the exemplary electrical adapter system of FIG. 1D;

FIG. 1F depicts a front view of another exemplary electrical adapter system in accordance with the present invention;

FIG. 1G depicts a front view of yet another exemplary electrical adapter system in accordance with the present invention;

FIG. 1H depicts a back view of the exemplary electrical adapter system of FIG. 1G;

FIG. 1I depicts a front view of still another exemplary electrical adapter system in accordance with the present invention that includes a stackable adapter;

FIG. 1J depicts a back view of the exemplary electrical adapter system of FIG. 1I;

DETAILED DESCRIPTION OF THE INVENTION

Figure 1B:
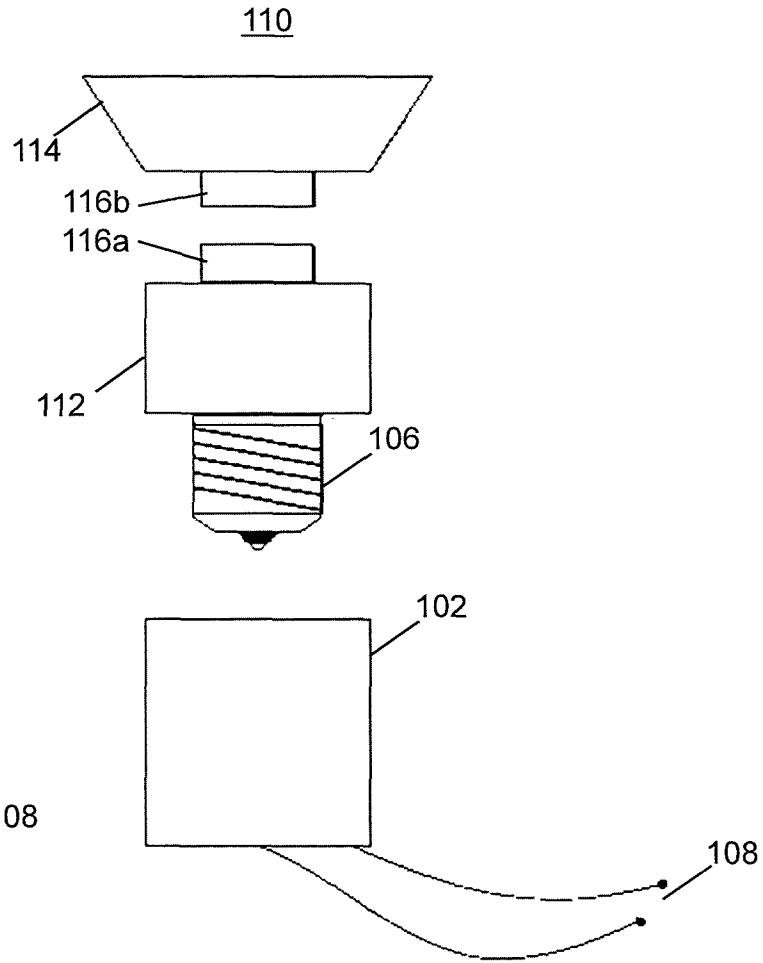
FIG. 1B depicts an exemplary electrical adapter system in accordance with the present invention comprising an electrical adapter and an exemplary electrical fixture.

The present invention will now be described more fully in detail with reference to the accompanying drawings, in which the preferred embodiments of the invention are shown. This invention should not, however, be construed as limited to the embodiments set forth herein; rather, they are provided so that this disclosure will be thorough and complete and will fully convey the scope of the invention to those skilled in the art.

The present invention provides an electrical adapter system. It involves magnetic techniques related to those described in U.S. Pat. No. 7,800,471, issued Sep. 21, 2010, U.S. Pat. No. 7,868,721, issued Jan. 11, 2011, U.S. Pat. No. 8,179,219, issued May 15, 2012, and U.S. Pat. No. 7,982,56, issued Jul. 19, 2011, which are all incorporated herein by reference in their entirety. The present invention may be applicable to systems and methods described in U.S. Pat. No. 7,681,256, issued Mar. 23, 2010, U.S. Pat. No. 7,750,781, issued Jul. 6, 2010, U.S. Pat. No. 7,755,462, issued Jul. 13, 2010, U.S. Pat. No. 7,812,698, issued Oct. 12, 2010, U.S. Pat. Nos. 7,817,002, 7,817,003, 7,817,004, 7,817,005, and 7,817,006, issued Oct. 19, 2010, U.S. Pat. No. 7,821,367, issued Oct. 26, 2010, U.S. Pat. Nos. 7,823,300 and 7,824,083, issued Nov. 2, 2010, U.S. Pat. No. 7,834,729, issued Nov. 16, 2010, U.S. Pat. No. 7,839,247, issued Nov. 23, 2010, U.S. Pat. Nos. 7,843,295, 7,843,296, and 7,843,297, issued Nov. 30, 2010, U.S. Pat. No. 7,893,803, issued Feb. 22, 2011, U.S. Pat. Nos. 7,956,711 and 7,956,712, issued Jun. 7, 2011, U.S. Pat. Nos. 7,951,068 and 7,958,575, issued Jun. 14, 2011, U.S. Pat. No. 7,963,818, issued Jun. 21, 2011, U.S. Pat. Nos. 8,015,752 and 8,016,330, issued Sep. 13, 2011, U.S. Pat. No. 8,035,260, issued Oct. 11, 2011, U.S. Pat. No. 8,115,581, issued Feb. 14, 2012, and U.S. patent application Ser. No. 12/895,589, filed Sep. 30, 2010, which are all incorporated by reference herein in their entirety. The invention may also incorporate techniques described in U.S. Provisional Patent Application 61/403,814, filed Sep. 22, 2010, U.S. Provisional Patent Application 61/455,820, filed Oct. 27, 2010, U.S. Provisional Patent Application 61/459,329, filed Dec. 10, 2010, U.S. Provisional Patent Application 61/459,994, filed Dec. 22, 2010, U.S. Provisional Patent Application 61/461,570, filed Jan. 21, 2011, and U.S. Provisional Patent Application 61/462,715, filed Feb. 7, 2011, which are all incorporated by reference herein in their entirety.

In accordance with one embodiment of the invention, an electrical adapter system comprises an electrical adapter and an electrical fixture. The electrical adapter provides an electrical connection to an Edison screw socket. The electrical adapter includes an Edison screw base, a voltage converter circuit, and a first electrical connector part.

The Edison screw base is configured to receive a primary voltage from a voltage source. The adapter receives the primary voltage, for example 120 VAC, from an Edison screw light bulb socket and converts the primary voltage using the voltage converter circuit as required to supply a secondary, typically lower, and optionally variable voltage required by the electrical fixture.

Voltage converter circuit is configured to convert the primary voltage to the secondary voltage. The voltage converter circuit may be a switched mode power supply such as a buck converter.

The first electrical connector part is configured to be detachably coupled to a second electrical connector part of an electrical fixture configured to be powered by the secondary voltage. The first electrical connector part and second electrical connector part form a two part correlated magnetic electrical connector connecting the electrical adapter and electrical fixture.

Under one arrangement, the two parts of the correlated magnetic electrical connector to have a fixed position when magnetically aligned. For example, the two parts are fixed (i.e., unable to move) within the electrical adapter and electrical fixtures. In another arrangement, at least one of the two parts of the correlated magnetic electrical connector can move within a bounded area(s) within the electrical adapter and/or the electrical fixture. A moveable part of the correlated magnetic electrical connector may be located to a position and then held in that position by a lock, which may be some mechanical means such as a set screw. Generally, any of various well known mechanical means can to "lock" and "unlock" a connector in accordance with the invention.

In an exemplary embodiment, the electrical adapter comprises a driver circuit and the electrical fixture comprises a light emitting diode (LED) lamp, where the driver circuit can provide a variable secondary voltage enabling control over the LED lamp brightness and power consumption.

In another embodiment, an electrical fixture 114 and/or an electrical adapter 112 (or stackable adapter 124) may comprise one or more of an audio input device 126*a* (e.g., a microphone), an audio output device 126*b* (e.g., a speaker), a video input device 126*c* (e.g., a movie camera), a video output device 126*d* (e.g., a display), a radar 126*e* (e.g., an ultra wideband radar), an environment sensor 126*f* (e.g., a temperature, moisture, carbon dioxide, radon, smoke, or other sensor), a network communications device 126*g* (e.g., a communications repeater device, a network router 126*h*, or a communications portal), a security sensor 126*i* (e.g., a motion sensor, infrared sensor, optical sensor, or other sensor), a light fixture 126*j* (e.g., Christmas tree lights), a timer device 126*k*, a remote control repeater device 126*l*, or a rechargeable battery 126*m* (e.g., to enable emergency lighting).

In a further embodiment, an electrical fixture 114 and/or an electrical adapter 112 (or stackable adapter 124) may function as part of a communication system 128*a*, a person/object/animal tracking system 128*b*, a security system 128*c*, an environment control system 128*d*, a environment monitoring system 128*e*, a gaming system 128*f*, an automation system 128*g*, or a media (e.g., audio, video) delivery system 128*h*. For example, an electrical adapter could include Blue Tooth or WiFi communications capabilities.

Under one arrangement, an electrical fixture 114 and/or an electrical adapter 112 (or stackable adapter 124) comprises at least one of a transponder 126*n*, a transmitter 126*o*, a receiver 126*p*, or an antenna 126*q*. Under another arrangement, an electrical adapter conveys communications signals via a wiring infrastructure to which an electrical outlet or an electrical fixture having an Edison screw light bulb socket is interfaced or otherwise connected. Under still another arrangement, an electrical adapter conveys tracking signals (e.g., time-domain reflectometry signals) via such a wiring infrastructure.

The magnetic sources employed in the invention may be permanent magnetic sources, electromagnets, electro-permanent magnets, or combinations thereof. Magnetic sources may be discrete magnets or may be printed into magnetizable material.

Figure 1A:
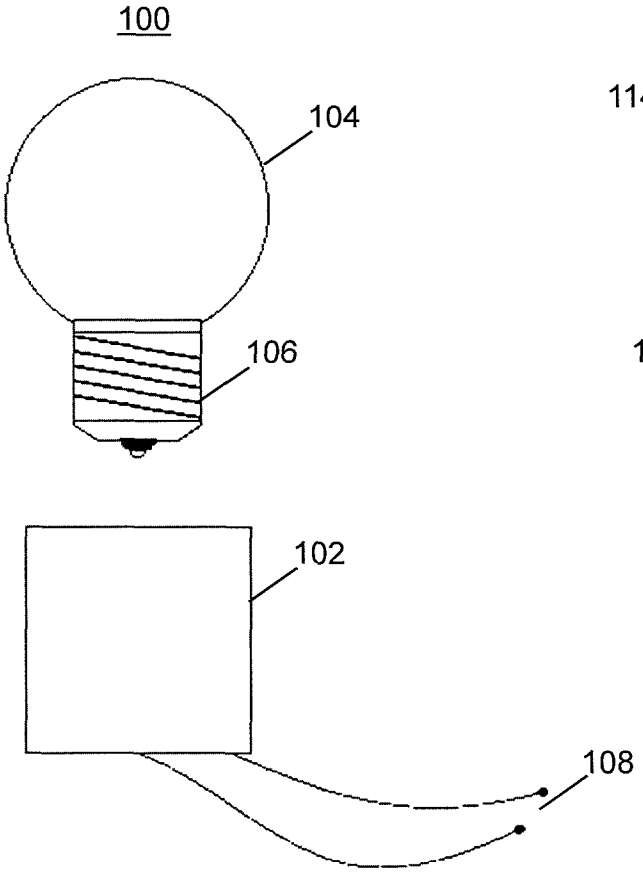
FIG. 1A (Prior Art)
FIG. 1A depicts an exemplary Edison screw light bulb socket and an exemplary Edison screw light bulb.

FIG. 1A depicts an exemplary Edison screw light bulb socket 102 and an exemplary Edison screw light bulb 100. The Edison screw light bulb 100 comprises a glass bulb portion 104 and an electrical male Edison screw base portion 106 that includes an electrical contact for receiving a voltage when placed (screwed) into the Edison screw light bulb socket 102. The electrical contact provides the voltage to a filament (not shown) inside the glass bulb portion 104 causing the light bulb 100 to produce light. The Edison screw light bulb socket 102 receives a voltage 108 from a primary voltage source, for example, a 120VAC voltage source. One skilled in the art will recognize that all sorts of Edison screw light bulb sockets 102 exist for use in the United States and/or in other countries that receive different voltages (e.g., 240VAC).

FIG. 1B depicts an exemplary electrical adapter system 110 in accordance with the present invention comprising an electrical adapter 112 and an exemplary electrical fixture 114. The electrical adapter 112 and electrical fixture 114 are connected physically and electrically using a first electrical connector part 116*a* and a second electrical connector part 116*b*. One skilled in the art will recognize that the electrical connection between the first and second electrical connector parts 116*a* 116*b* could be implemented using a plug and socket approach, an Edison screw socket approach, or any other electrical connector approach, whereby wiring, contacts, plugs, and sockets are not shown. Additionally, the shapes of the electrical adapter 112 and the electrical fixture 114 were arbitrarily chosen and can be shaped and sized as appropriate. Furthermore, although a single electrical fixture 114 is shown being attachable to an electrical adapter 112, two or more electrical fixtures 114 could be attachable to a single electrical adapter 112 having multiple first electrical connector parts 116*a* (not shown), where the driver circuitry of the electrical adapter could be configured to supply the same (or different) types of secondary voltage types as required to support the same (or different) voltage requirements of multiple electrical fixtures 114.

FIG. 1C depicts an exemplary electrical outlet 118 having two electrical sockets 120 for receiving electrical plugs (not shown) such as can be found on power cords for common electrical fixtures and electrical appliances including table lamps, televisions, computers, toasters, vacuum cleaners, and the like. One skilled in the art will recognize that the electrical outlet 118 could be a 120 VAC voltage source or any other voltage source available in the United States and/or in other countries (e.g., 240 VAC) and can conform to any of the many well known plug standards including Type A, Type B, Type C, Type D, Type E, Type F, Type E/F hybrid, Type G, Type H, Type I, Type J, Type K, Type L, Type M, or any other desired type.

FIG. 1D depicts a front view of an exemplary electrical adapter system 110 in accordance with the present invention. Instead of an Edison screw light bulb socket 102, the electrical adapter system 110 has a plug 122 able to connect into one of the electrical sockets 120 of the electrical outlet 118 of FIG. 1C.

FIG. 1E depicts a back view of the exemplary electrical adapter system 110 of FIG. 1D, which includes an optional electrical socket 120 enabling a person to connect the electrical adapter system 110 into an electrical socket 120 of an electrical outlet 118 while still providing an electrical socket 120 for receiving a plug such as a power cord for a vacuum cleaner. The electrical socket 120 outputs a voltage based on the primary voltage. For example, the electrical socket 120 may output a voltage with the same voltage as the primary voltage. The optional electrical socket 120 also enables two or more electrical adapter systems 110 to be daisy-chained to an electrical outlet 118. As such, multiple (perhaps different) electrical fixtures can be powered by a single electrical outlet 118.

FIG. 1F depicts a front view of another exemplary electrical adapter system 110 in accordance with the present invention, which is like the electrical adapter system 110 of FIGS. 1D and 1E except the plug 122 is on the bottom of the electrical adapter 112.

FIG. 1G depicts a front view of yet another exemplary electrical adapter system 110 in accordance with the present invention. As shown, the electrical adapter system 110 includes an electrical male Edison screw base portion 106 and an electrical plug 122 enabling the electrical adapter system 110 to be connected to either an Edison light bulb socket 102 or an electrical outlet 118.

FIG. 1H depicts a back view of the exemplary electrical adapter system 110 of FIG. 1G. As shown, the exemplary electrical adapter system 110 includes an optional electrical socket 120 enabling a plug of a device to be connected and/or enables daisy-chaining of multiple electrical adapter systems 110.

FIG. 1I depicts a front view of still another exemplary electrical adapter system 110 in accordance with the present invention that includes a stackable adapter 124. The first electrical connector part is configured to be detachably coupled to the stackable adapter 124. The stackable adapter 124 includes a third electrical connector part configured to be detachably coupled to the first electrical connector part of the electrical adapter and a fourth electrical connector part configured to be detachably coupled to the second electrical connector part of the electrical fixture. The third electrical connector part of the stackable adapter 124 may be identical to the second electrical connector part of the electrical fixture 114. The fourth electrical connector part of the stackable adapter 124 may be identical to the first electrical connector part of the electrical adapter 112.

The stackable adapter 124 is configured to reside between an electrical adapter 112 configured with an electrical plug 122 for connection into an electrical outlet. Alternatively, a stackable adapter 124 can be configured to reside between an electrical adapter 112 configured with an electrical male Edison screw base portion 106 enabling the electrical adapter system 110 to be connected to either an Edison light bulb socket 102. As described in relation to FIGS. 1G and 1H the stackable adapter 124 could be configured to reside between an electrical adapter configured to connect to an electrical outlet 118 or to an Edison light bulb socket 102. Moreover, multiple stackable adapters 120 can be placed between an electrical adapter 112 and an electrical fixture 114.

FIG. 1J depicts a back view of the exemplary electrical adapter system 110 of FIG. 1I having a stackable electrical adapter 124, where both adapters 112 124 include an optional electrical socket 120. One skilled in the art will recognize that all sorts of combinations of electrical adapters 112, stackable adapters 124, and electrical fixtures 114 are possible as configured using various combinations of electrical sockets 120, electrical plugs 122, and electrical male Edison screw base portions 106.

Figure 2A:
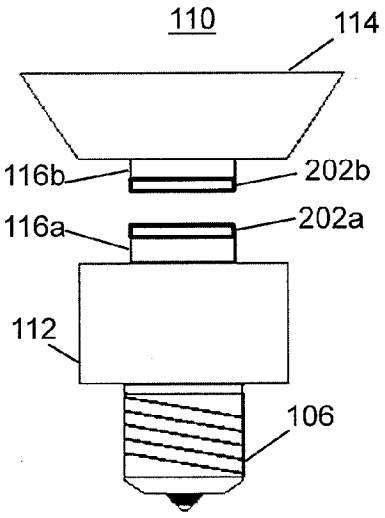
FIG. 2A depicts two exemplary components of a correlated magnetic electrical connector used to magnetically attach and electrically connect the electrical adapter and electrical fixture of an electrical adapter system in accordance with the present invention.

FIG. 2A depicts two exemplary components 202*a* 202*b* of a correlated magnetic electrical connector used to magnetically attach and electrically connect the electrical adapter 112 and electrical fixture 114 of an electrical adapter system 110 in accordance with the present invention. As shown in FIG. 2A, the first electrical connector part 116*a* comprises a first correlated magnetic electrical connector component 202*a* and the second electrical connector part 116*b* comprises a second correlated magnetic electrical connector component 202*b*. As such, the first and second electrical connector parts 116*a* 116*b* serve as housings for and include electrical wiring/circuitry connecting to the respective first and second correlated magnetic electrical connector components 202*a* 202*b*. The first and second correlated magnetic electrical connector components 202*a* 202*b* are configured at or near the surface of the first and second electrical connector parts 116*a* 116*b* enabling them to be magnetically attached by aligning the first and second correlated magnetic electrical connector components 202*a* 202*b* using sideways translational movement. Once the first and second correlated magnetics connector components 202*a* 202*b* are magnetically attached, the electrical adapter 112 and the electrical fixture 114 of the electrical adapter system 110 are electrically connected.

Figure 2B:
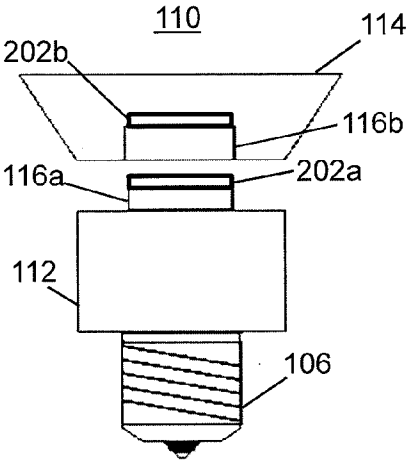
FIG. 2B depicts another two exemplary parts of a correlated magnetic electrical connector used to attach the parts of a electrical adapter system in accordance with the present invention.

FIG. 2B depicts another two exemplary components 202*a* 202*b* of a correlated magnetic electrical connector used to magnetically attach and electrically connect the electrical adapter 112 and electrical fixture 114 of an electrical adapter system 110 in accordance with the present invention. As shown in FIG. 2B, the second electrical connector part 116*b* and second correlated magnetic electrical connector 202*b* are recessed into the electrical fixture 114 to serve as a female portion of a male-female connector, whereby the first electrical connector part 116*a* and first correlated magnetic electrical connector 202*a* serve as the male portion of the male-female connector. Electrical wiring attached to the second correlated magnetic electrical connector 202*b* could reside in the electrical fixture 114 and could reside in the second electrical connector part 116*b* or the second electrical connector part 116*b* could merely act as a housing in which the second correlated magnetic electrical connector 202*b* resides and within which the first electrical connector part 116*a* and first correlated magnetic electrical connector 202*a* are inserted. One skilled in the art will recognized that the male-female connector approach prevents the use of sideways translational movement and instead requires up and down translational movement and (optionally) rotational movement.

Figure 2C:
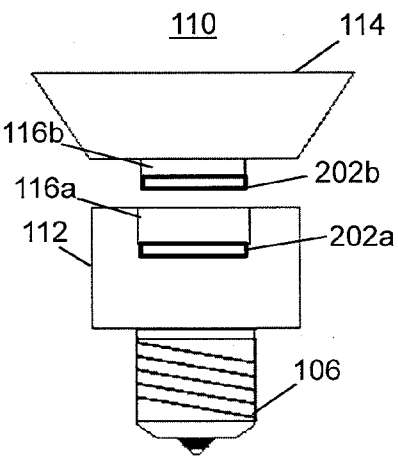
FIG. 2C depicts yet another two exemplary components of a correlated magnetic electrical connector used to attach the parts of a electrical adapter system in accordance with the present invention.

FIG. 2C depicts yet another two exemplary components 202*a* 202*b* of a correlated magnetic electrical connector used to attach the electrical adapter 112 and electrical fixture 114 of an electrical adapter system 110 in accordance with the present invention. As shown in FIG. 2C, the first electrical connector part 116*a* and second correlated magnetic electrical connector 202*a* are recessed into the electrical adapter 112 to serve as a female portion of a male-female connector, whereby the second electrical connector part 116*b* and second correlated magnetic electrical connector 202*b* serve as the male portion of the male-female connector. Electrical wiring attached to the first correlated magnetic electrical connector 202*a* could reside in the electrical adapter 112 and could reside in the first electrical connector part 116*a* or the first electrical connector part 116*a* could merely act as a housing in which the first correlated magnetic electrical connector 202*a* resides and within which the second electrical connector part 116*b* and second correlated magnetic electrical connector 202*b* are inserted.

Figure 2D:
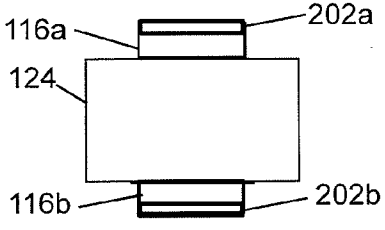
FIG. 2D depicts an exemplary stackable adapter that can be used with the two exemplary components of the correlated magnetic electrical connector of FIG. 2A.

FIG. 2D depicts an exemplary stackable adapter 124 that can be used with the two exemplary components 202*a* 202*b* of the correlated magnetic electrical connector of FIG. 2A. As shown in FIG. 2D, the first component 202*a* of the correlated magnetic electrical connector of the exemplary stackable adapter 124 can connect to the second component 202*b* of the correlated magnetic electrical connector associated with the electrical fixture 114 of the electrical adapter systems 110 of FIGS. 2A-2C. Similarly, the second component 202*b* of the correlated magnetic electrical connector of the exemplary adapter 124 can connect to the first component 202*a* of the correlated magnetic electrical connector of the electrical adapter 112 of the electrical adapter systems 110 of FIGS. 2A-2C. Moreover, multiple stackable adapters 124 can be daisy-chained between an electrical fixture 114 and electrical adapter 112 of an electrical adapter system 110 in accordance with the present invention, whereby the first component 202*a* of the correlated magnetic electrical connector of the a first stackable adapter 124 will connect to the second component 202*b* of the correlated magnetic electrical connector of the second stackable adapter 124, and so on.

Figure 2E:
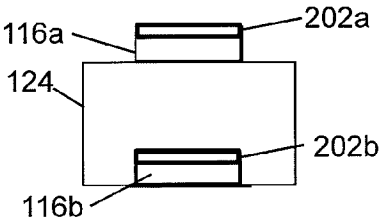
FIG. 2E depicts an exemplary stackable adapter that can be used with the two exemplary components of the correlated magnetic electrical connector of FIG. 2B.

FIG. 2E depicts an exemplary stackable adapter 124 that can be used with the two exemplary components 202*a* 202*b* of the correlated magnetic electrical connector of FIG. 2B. In a manner similar to what has been described in relation to FIG. 2D, one or more stackable adapters 124 such as depicted in FIG. 2E can reside between the electrical adapter 112 and electrical fixture 114 of the electrical adapter systems 110 of FIG. 2A or 2B.

Figure 2F:
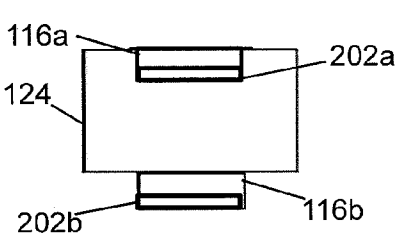
FIG. 2F depicts an exemplary stackable adapter that can be used with the two exemplary components of the correlated magnetic electrical connector of FIG. 2C.

FIG. 2F depicts an exemplary stackable adapter 124 that can be used with the two exemplary components 202*a* 202*b* of the correlated magnetic electrical connector of FIG. 2C. In a manner similar to what has been described in relation to FIG. 2D, one or more stackable adapters 124 such as depicted in FIG. 2F can reside between the electrical adapter 112 and electrical fixture 114 of the electrical adapter systems 110 of FIG. 2A or 2C. An alternative stackable adapter 124 (not shown) could have exemplary components 202*a* 202*b* of a correlated magnetic electrical connector that both function as female portions of a male-female connector that could be used with the electrical adapter system 110 of FIG. 2A.

Figure 3A:
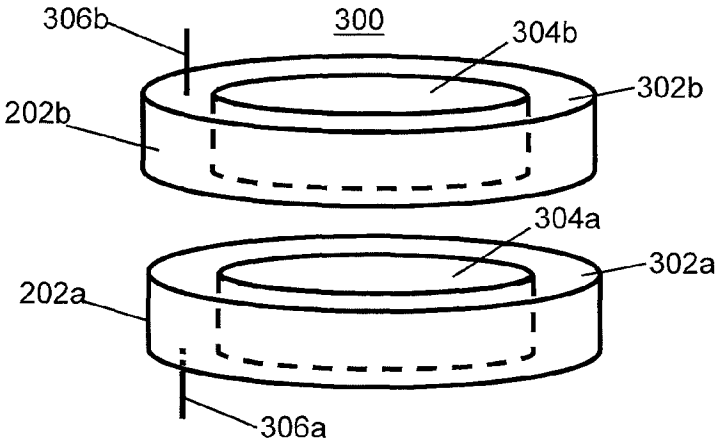
FIG. 3A depicts exemplary ring-shaped electrical contact portions and exemplary circularly-shaped correlated magnetic structure portions of two exemplary components of a correlated magnetic electrical connector in accordance with the present invention.

FIG. 3A depicts exemplary ring-shaped electrical contact portions 302*a* 302*b* and exemplary circularly-shaped correlated magnetic structure portions 304*a* 304*b* of two exemplary components 202*a* 202*b* of a correlated magnetic electrical connector 300 in accordance with the present invention. As shown, electrical cables 306*a* 306*b* are connected to the ring-shaped electrical contact portions 302*a* 302*b*, respectively.

Figure 3B:
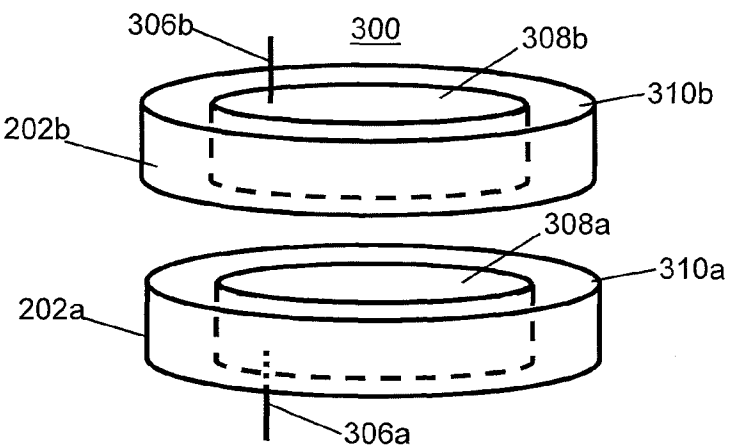
FIG. 3B depicts exemplary circularly-shaped electrical contact portions and exemplary ring-shaped correlated magnetic structure portions of two exemplary components of a correlated magnetic electrical connector in accordance with the present invention.

FIG. 3B depicts exemplary circularly-shaped electrical contact portions 308*a* 308*b* and exemplary ring-shaped correlated magnetic structure portions 310*a* 310*b* of two exemplary components 202*a* 202*b* of a correlated magnetic electrical connector 300 in accordance with the present invention. As shown, electrical cables 306*a* 306*b* are connected to the circularly-shaped electrical contact portions 308*a* 308*b*, respectively.

Figure 3C:
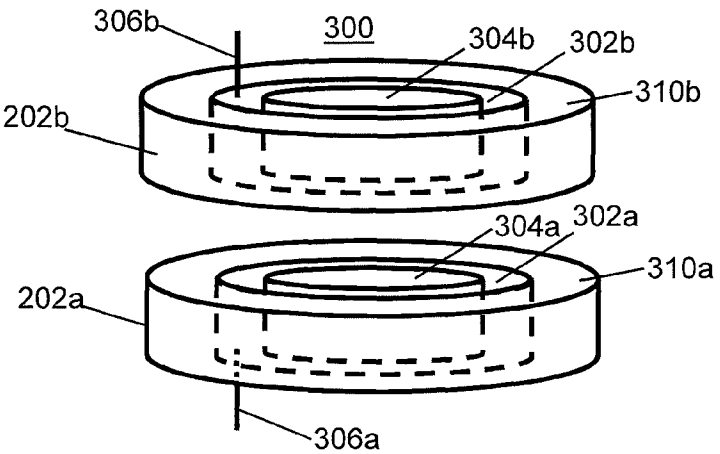
FIG. 3C depicts exemplary ring-shaped electrical contact portions and exemplary circularly-shaped and ring-shaped correlated magnetic structure portions of two exemplary components of a correlated magnetic electrical connector in accordance with the present invention.

FIG. 3C depicts exemplary ring-shaped electrical contact portions 302*a* 302*b* and exemplary circularly-shaped 304*a* 304*b* and ring-shaped 310*a* 310*b* correlated magnetic structure portions of two exemplary components 202*a* 202*b* of a correlated magnetic electrical connector 300 in accordance with the present invention. As shown, electrical cables 306*a* 306*b* are connected to the ring-shaped electrical contact portions 302*a* 302*b*, respectively.

Figure 3D:
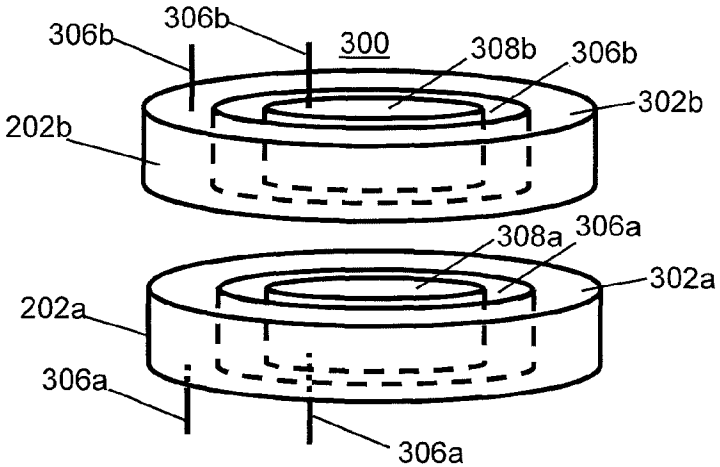
FIG. 3D depicts exemplary ring-shaped and circularly-shaped electrical contact portions and exemplary ring-shaped correlated magnetic structure portions of two exemplary components of a correlated magnetic electrical connector in accordance with the present invention.

FIG. 3D depicts exemplary ring-shaped electrical contact portions 306*a* 306*b* and circularly-shaped electrical contact portions 302*a* 302*b* and exemplary ring-shaped correlated magnetic structure portions 306*a* 306*b* of two exemplary components 202*a* 202*b* of a correlated magnetic electrical connector 300 in accordance with the present invention. As shown, electrical cables 306*a* 306*b* are connected to the ring-shaped electrical contact portions 302*a* 302*b*, respectively, and to the circularly-shaped electrical contact portions 308*a* 308*b*, respectively.

Figure 4A:
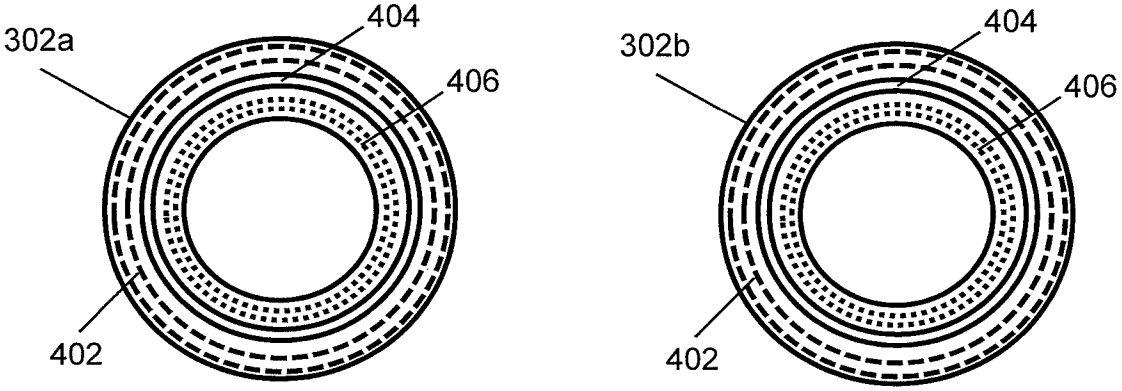
FIG. 4A depicts exemplary electrical contacts of exemplary ring-shaped electrical portions of two exemplary components of a correlated magnetic electrical connector in accordance with the present invention.

FIG. 4A depicts exemplary electrical contacts 402 404 406 of exemplary ring-shaped electrical portions of two exemplary components 302*a* 302*b* of a correlated magnetic electrical connector 300 in accordance with the present invention. As shown in FIG. 4A, outermost ring-shaped electrical portions 402 indicated by two dashed circular lines surround middle ring-shaped electrical portions 404 indicated by two solid circular lines that surround the innermost ring-shaped electrical portions 406 indicated by two dotted circular lines. As such, when the two components 302*a* 302*b* are aligned and in contact, there corresponding electrical contact portions 402 404 406 become in contact providing three separate electrical connections, which could be used for example for power, ground, and communications. Generally, to practice the invention, at least two electrical contact portions are required to provide power and ground connectivity but one or more additional electrical contact portions can also be used for other purposes (e.g., for communications, to provide a control signal, or to provide a data signal). Communications connectivity may be used, for example, to identify to an electrical adapter the type of electrical fixture that has been connected to it (or vice versa), to provide sensor information, to provide control signals, etc. Alternatively, two or more electrical contact portions could be used to provide two or more different types of electrical power (e.g., different voltages).

Figure 4B:
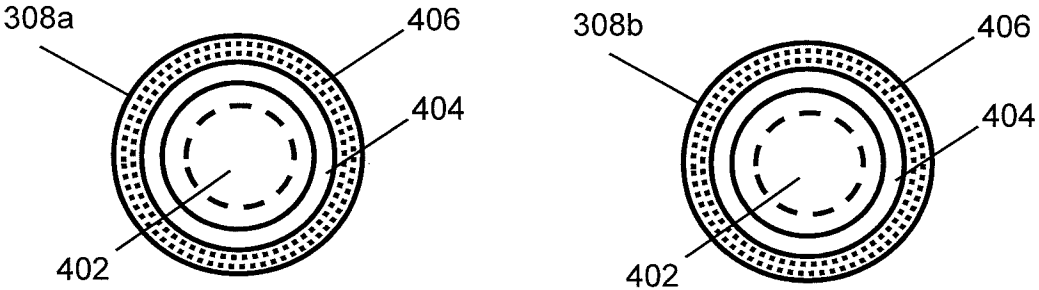
FIG. 4B depicts exemplary electrical contacts of exemplary circularly-shaped electrical portions of two exemplary components of a correlated magnetic electrical connector in accordance with the present invention.

FIG. 4B depicts exemplary electrical contacts of exemplary circularly-shaped electrical portions of two exemplary components of a correlated magnetic electrical connector in accordance with the present invention. As with the electrical contacts of FIG. 4A, three different contact portions 402 404 406 are shown, which might correspond (in no particular order) to communications, power, and ground. As described in relation to FIG. 4A, all sorts of combinations are possible including multiple power connections for supplying different voltages, and so forth.

Figure 5A:
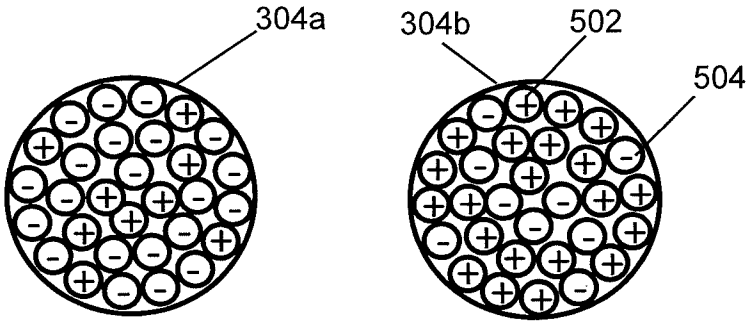
FIG. 5A depicts exemplary circularly-shaped complementary correlated magnetic structure portions of two exemplary components of a correlated magnetic electrical connector in accordance with the present invention.

FIG. 5A depicts exemplary circularly-shaped complementary correlated magnetic structure portions 304*a* 304*b* of two exemplary components of a correlated magnetic electrical connector 300 in accordance with the present invention. As shown in FIG. 5A, the correlated magnetic structure portions 304*a* 304*b* have complementary (i.e., mirror image) patterns of positive maxels 502 and negative maxels 504. The specific patterns used for the magnetic structure portions 304*a* 304*b* of a correlated magnetic electrical connector 300 can be selected to have only one rotational alignment where the maxels will all correlate. Alternatively, they may be coded to allow several different correlated positions (e.g., every 60 degrees). The coding pattern used in FIG. 5A comprises three concentric circles of maxels with the outer circle corresponding to four Barker 4 code modulos, the middle circle corresponding to two Barker 5 code modulos, and the innermost circle corresponding to a complementary Barker 4 code modulo.

Figure 5B:
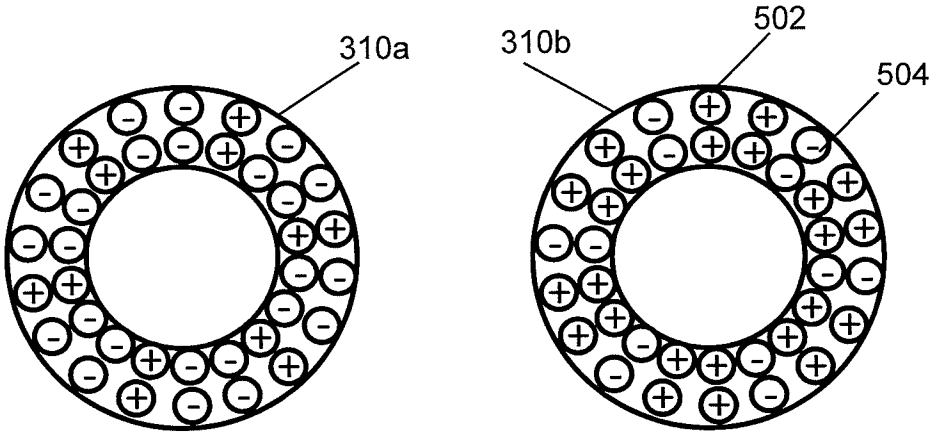
FIG. 5B depicts exemplary ring-shaped complementary correlated magnetic structure portions of two exemplary components of a correlated magnetic electrical connector in accordance with the present invention.

FIG. 5B depicts exemplary ring-shaped complementary correlated magnetic structure portions 310*a* 310*b* of two exemplary components of a correlated magnetic electrical connector 300 in accordance with the present invention. As shown in FIG. 5B, the correlated magnetic structure portions 310*a* 310*b* have complementary (i.e., mirror image) patterns of positive maxels 502 and negative maxels 504. As with the correlated magnetic portions 304*a* 304*b* of FIG. 5A, the specific patterns used for the magnetic structure portions 310*a* 310*b* of a correlated magnetic electrical connector 300 of FIG. 5B can be selected to have only one rotational alignment where the maxels will all correlate or they may be coded to allow several different fully or partially correlated positions. The coding may cause certain rotational alignments where a repel force is produced. Generally, all sorts of magnetic behaviors can be prescribed using correlated magnetics coding techniques. The coding pattern used in FIG. 5B comprises two concentric circles of maxels oriented in a radial pattern, where the two concentric circles each correspond to six code modulos of a Barker 3 code.

Figure 5C:
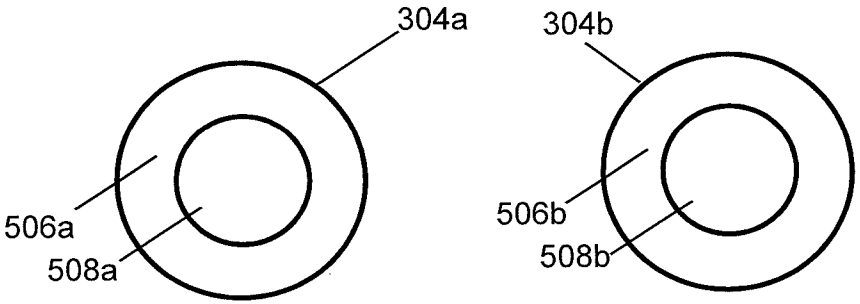
FIG. 5C depicts another exemplary circularly-shaped multi-level correlated magnetic structure portions of two exemplary components of a correlated magnetic electrical connector in accordance with the present invention.
Figure 5D:
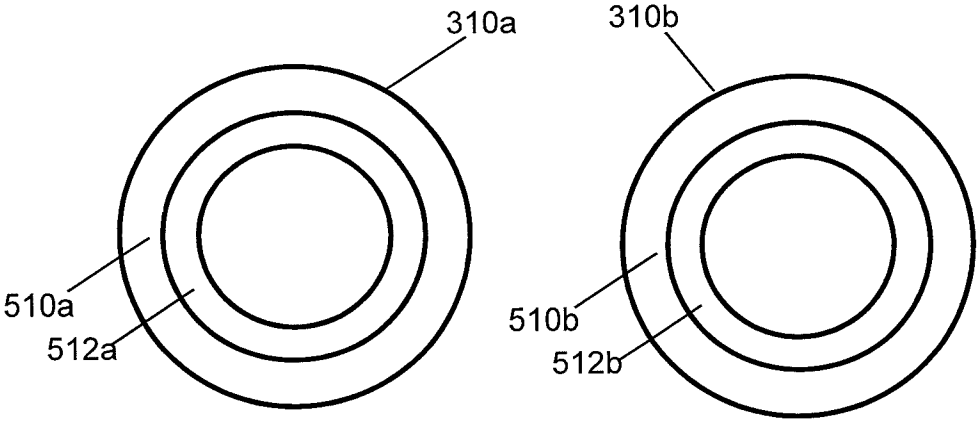
FIG. 5D depicts exemplary ring-shaped multi-level correlated magnetic structure portions of two exemplary components of a correlated magnetic electrical connector in accordance with the present invention.

FIGS. 5C and 5D are representative of the use of multi-level correlated magnetic structures as the correlated magnetic structure portions of a correlated magnetic electrical connector. Multi-level correlated magnetic structures are described in U.S. patent application Ser. No. 12/885,450, filed Sep. 18, 2010, which is incorporated herein by reference. Generally, such multi-level correlated structures have first and second regions the produce different force vs. distance characteristics that combine to cause magnetic forces that transition from an attract state to a repel state depending on the distance the structures are separated.

FIG. 5C depicts exemplary circularly-shaped multi-level correlated magnetic structure portions 304*a* 304*b* of two exemplary components of a correlated magnetic electrical connector 300 in accordance with the present invention. As shown, the first circularly-shaped multi-level correlated magnetic structure portion 304*a* comprises a first region 506*a* and a second region 508*a* and the second circularly-shaped multi-level correlated magnetic structure portion 304*b* also comprises a first region 506*b* and a second region 508*b* that interact with the two regions 506*a* 508*a* of the first circularly-shaped multi-level correlated magnetic structure portion 304*a* to produce multi-level magnetism. As shown, the two first regions 506*a* 506*b* are ring-shaped and the second regions 508*a* 508*b* are circularly-shaped. Many other shapes of two or more regions could also be employed to produce multi-level magnetism.

FIG. 5D depicts exemplary ring-shaped multi-level correlated magnetic structure portions of two exemplary components of a correlated magnetic electrical connector in accordance with the present invention. As shown, the first ring-shaped multi-level correlated magnetic structure portion 310*a* comprises a first region 510*a* and a second region 512*a* and the second ring-shaped multi-level correlated magnetic structure portion 310*b* also comprises a first region 510*b* and a second region 512*b* that interact with the two regions 510*a* 512*a* of the first ring-shaped multi-level correlated magnetic structure portion 310*a* to produce multi-level magnetism. As shown, the two first regions 510*a* 512*b* are ring-shaped and the second regions 510*a* 512*b* are ring-shaped. Many other shapes of two or more regions could also be employed to produce multi-level magnetism.

Although, the exemplary connectors and associated magnetic structures have been described herein as being circularly-shaped and ring-shaped, one skilled in the art will recognize that other shapes including square, rectangular, or any other desired shape could be employed in accordance with the invention.

While particular embodiments of the invention have been described, it will be understood, however, that the invention is not limited thereto, since modifications may be made by those skilled in the art, particularly in light of the foregoing teachings.

The invention claimed is:

1. A stackable electrical adapter, comprising:

one of a first electrical connector part that is located on a first side of said stackable electrical adapter, said first electrical connector part being configured to be detachably coupled to an electrical adapter, said electrical adapter comprising:

at least one of an electrical plug or an Edison screw base configured to receive a primary voltage from a primary voltage source; and a voltage converter circuit configured to convert the primary voltage to a secondary voltage; and one of a second electrical connector part that is located on a second side of said stackable electrical adapter that is opposite said first side, said second electrical connector part being configured to be detachably coupled to an electrical fixture configured to be powered by the secondary voltage, each of said first electrical connector part and said second electrical connector part comprising:

a first contact portion for providing a secondary voltage;

a second contact portion for providing a ground; and a third contact portion for providing a data signal, said first, second, and third contact portions of each said first electrical connector part being configured to provide an electrical connection with said first, second, and third contact portions of each said second electrical connector part enabling daisy-chaining of multiple stackable electrical adapters.

2. The stackable electrical adapter of claim 1, wherein said primary voltage source is an electrical socket of an electrical outlet.

3. The stackable electrical adapter of claim 1, wherein said stackable electrical adapter comprises an audio input device.

4. The stackable electrical adapter of claim 1, wherein said stackable electrical adapter comprises an audio output device.

5. The stackable electrical adapter of claim 1, wherein said stackable electrical adapter comprises a video input device.

6. The stackable electrical adapter of claim 1, wherein said stackable electrical adapter comprises a video output device.

7. The stackable electrical adapter of claim 1, wherein said stackable electrical adapter comprises a radar.

8. The stackable electrical adapter of claim 1, wherein said stackable electrical adapter comprises an environment sensor.

9. The stackable electrical adapter of claim 1, wherein said stackable electrical adapter comprises a network communications device.

10. The stackable electrical adapter of claim 1, wherein said stackable electrical adapter comprises a security sensor.

11. The stackable electrical adapter of claim 1, wherein said stackable electrical adapter comprises a timer device.

12. The stackable electrical adapter of claim 1, wherein said stackable electrical adapter comprises a remote control repeater device.

13. The stackable electrical adapter of claim 1, wherein said stackable electrical adapter comprises a rechargeable battery.

14. The stackable electrical adapter of claim 1, wherein at least one of said stackable electrical adapter or said electrical fixture functions as part of one of a communication system, a tracking system, a security system, an environment control system, an environment monitoring system, a gaming system, an automation system, or a media delivery system.

15. The stackable electrical adapter of claim 1, wherein at least one of said stackable electrical adapter or said electrical fixture comprises at least one of a transponder, a transmitter, a receiver, or an antenna.

16. The stackable electrical adapter of claim 1, wherein said electrical adapter conveys signals via a wiring infrastructure to which said electrical plug is interfaced.

17. An electrical adapter system, comprising:

an electrical adapter, comprising:

an electrical plug configured to receive a primary voltage from a primary voltage source;

a voltage converter circuit configured to convert the primary voltage to a secondary voltage; and one of a first electrical connector part configured to be detachably coupled to one of a second electrical connector part of an electrical fixture configured to be powered by the secondary voltage; and at least one stackable electrical adapter configured to be placed between said electrical adapter and said electrical fixture, each said stackable electrical adapter of said at least one stackable electrical adapter having one of said first electrical connector part that is located on a first side and having one of said second electrical connector part that is located on a second side that is opposite said first side, each said first electrical connector part and each said second electrical connector part comprising:

a first contact portion for providing said secondary voltage;

a second contact portion for providing a ground; and a third contact portion for providing a data signal, said first, second, and third contact portions of each said first electrical connector part being configured to provide an electrical connection with said first, second, and third contact portions of each said second electrical connector part enabling daisy-chaining of multiple stackable electrical adapters between said electrical adapter and said electrical fixture.

18. The electrical adapter system of claim 17, wherein the primary voltage is greater than the secondary voltage.

19. The electrical adapter system of claim 17, wherein said electrical adapter further comprises another electrical socket that outputs a voltage based on the primary voltage.

20. The electrical adapter system of claim 17, wherein said electrical fixture comprises a light emitting diode lamp, wherein the voltage converter circuit enables variation of the secondary voltage to control brightness and power consumption of the light emitting diode lamp.

* * * * *